US011267242B2

(12) United States Patent
Miyake

(10) Patent No.: US 11,267,242 B2
(45) Date of Patent: Mar. 8, 2022

(54) INK JET RECORDING APPARATUS THAT PREVENTS WASTEFUL CONSUMPTION OF INK

(71) Applicant: KYOCERA Document Solutions Inc., Osaka (JP)

(72) Inventor: Masayuki Miyake, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/112,811

(22) Filed: Dec. 4, 2020

(65) Prior Publication Data

US 2021/0178753 A1 Jun. 17, 2021

(30) Foreign Application Priority Data

Dec. 12, 2019 (JP) ..... JP2019-224899

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC ..... B41J 2/0451; B41J 2/045; B41J 2/04586; B41J 2/21; B41J 25/308
See application file for complete search history.

(56) References Cited

U.S. PATENT DOCUMENTS 10,906,302 B2 * 2/2021 Ohara ..... B41J 2/2103

FOREIGN PATENT DOCUMENTS

JP 2008-003912 A 1/2008

* cited by examiner

*Primary Examiner* — Thinh H Nguyen
(74) *Attorney, Agent, or Firm* — IP Business Solutions, LLC

(57) ABSTRACT

An ink jet recording apparatus includes a controller that causes an image recording device, upon detecting an error with a recording sheet according to information acquired by an error information acquisition device, to suspend image recording on the recording sheet with which the error has been detected, and on another recording sheet being transported on an upstream side in a transport direction, of the recording sheet with which the error has been detected, and to perform a predetermined protective ejection including protecting an ink jet head of the image recording device, by ejecting a limited minute amount of ink from the ink jet head, at least onto a recording sheet transported subsequent to the recording sheet the image recording on which has been suspended.

5 Claims, 5 Drawing Sheets

INK JET RECORDING APPARATUS THAT PREVENTS WASTEFUL CONSUMPTION OF INK

INCORPORATION BY REFERENCE

This application claims priority to Japanese Patent Application No. 2019-224899 filed on Dec. 12, 2019, the entire contents of which are incorporated by reference herein.

BACKGROUND

The present disclosure relates to an ink jet recording apparatus that ejects ink onto a recording sheet thereby recording an image on the recording sheet, and in particular to a technique to prevent wasteful consumption of the ink.

Existing ink jet recording apparatuses are configured to eject ink on a recording sheet while transporting the same, to thereby record an image on the recording sheet. When an error occurs with the recording sheet, such that the recording sheet is bent or perforated, that the size of the recording sheet disaccords with the designated size, or that the position of the recording sheet is shifted, the recording sheet being transported is discharged after the image is recorded thereon, and the transport of subsequent recording sheet and the image recording is suspended. Accordingly, when a plurality of recording sheets have already been delivered from the paper cassette by the time that the error has occurred with the recording sheet, images are recorded on the respective recording sheets, which leads to wasteful consumption of a large amount of ink.

In the case of a printing system based on electrophotography, when an under-run error occurs during a duplex printing operation, the status of the recording sheets detained inside the printer is identified. For a recording sheet on which the image has been successfully printed on one face, the print data for the other face is transmitted so that the duplex printing is completed. For a recording sheet made to stand by for the data for one face because of the under run error, blank data is transmitted as the print data for the other face, so that wasteful consumption of the toner can be prevented.

SUMMARY

The disclosure proposes further improvement of the foregoing technique.

In an aspect, the disclosure provides an ink jet recording apparatus including a paper feeding device, a transport device, an image recording device, an error information acquisition device, and a control device. The paper feeding device includes a paper cassette for storing a recording sheet, and feeds the recording sheet from the paper cassette. The transport device sequentially transports a plurality of recording sheets delivered from the paper feeding device. The image recording device includes an ink jet head that ejects ink, and records an image on the recording sheet by ejecting the ink from the ink jet head onto the recording sheet transported by the transport device. The error information acquisition device is located upstream of the image recording device in a transport direction of the recording sheet, and acquires information to be used to detect an error with the recording sheet transported by the transport device. The control device includes a processor, and acts as a controller when the processor executes a control program. The controller causes the image recording device, upon detecting an error with the recording sheet according to the information acquired by the error information acquisition device, to suspend the image recording on the recording sheet with which the error has been detected, and on another recording sheet being transported upstream in the transport direction, of the recording sheet with which the error has been detected, and to perform a predetermined protective ejection including protecting the ink jet head of the image recording device, by ejecting a limited minute amount of ink from the ink jet head, at least onto a recording sheet transported subsequent to the recording sheet the image recording on which has been suspended.

DETAILED DESCRIPTION

Hereafter, an ink jet recording apparatus according to an embodiment of the disclosure will be described, with reference to the drawings.

Figure 1:
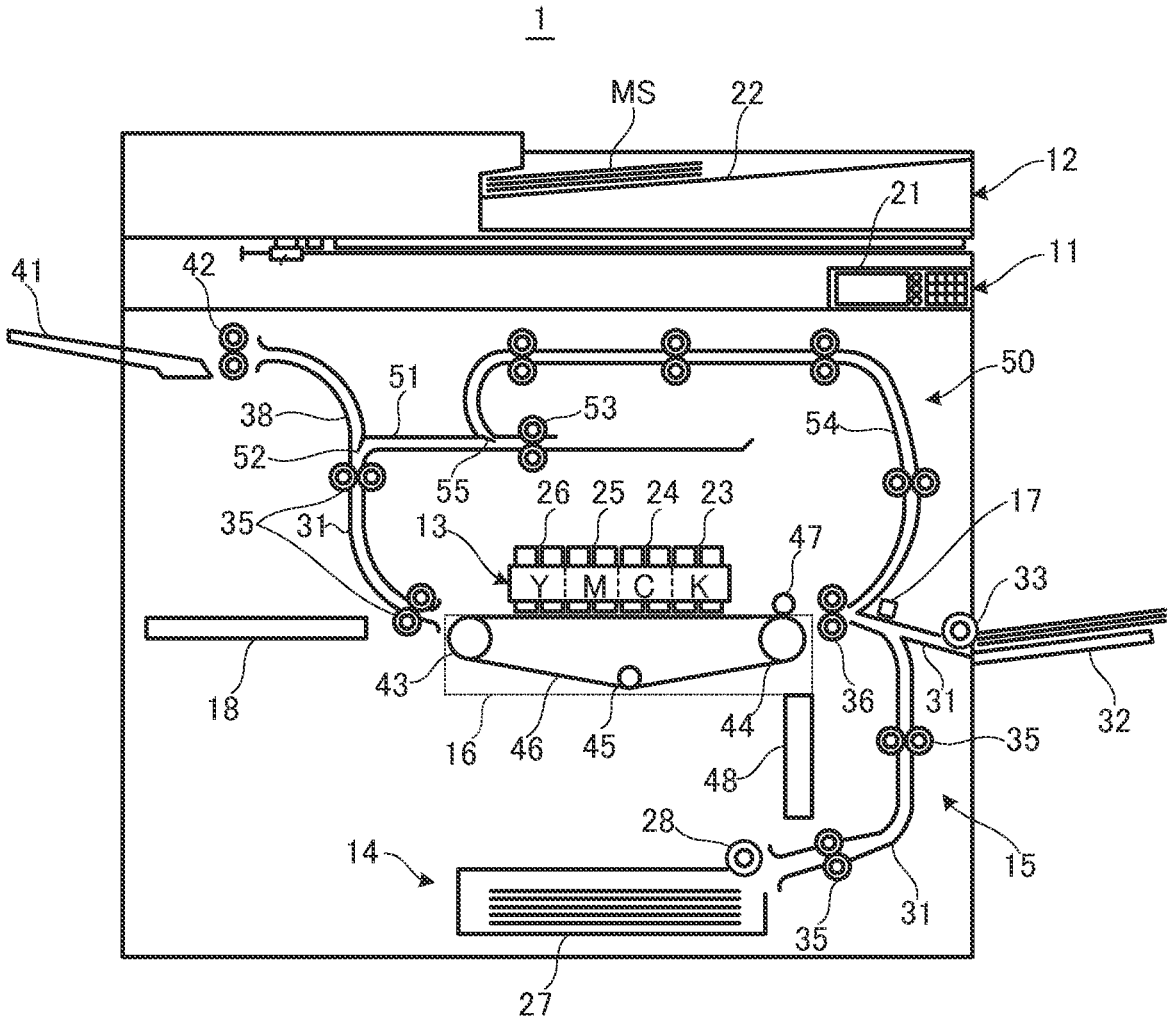
FIG. 1 is a cross-sectional view showing an ink jet recording apparatus according to an embodiment of the disclosure.

FIG. 1 is a cross-sectional view showing the ink jet recording apparatus according to the embodiment of the disclosure. The ink jet recording apparatus 1 according to this embodiment includes an operation device 11, a document reading device 12, an image recording device 13, a paper feeding device 14, a transport device 15, a conveying device 16, a contact image sensor (CIS) 17, and a cap 18.

The operation device 11 is to be operated by a user to input instructions to execute the functions and operations that the ink jet recording apparatus 1 is configured to perform. The operation device 11 includes a display device 21 for displaying, for example, an operation guide for the user. The display device 21 includes a display panel such as an LCD.

In the document reading device 12, when a plurality of source documents MS are placed on a document tray 22, the image on one face of the source document MS is read by an image sensor, or the respective images on both faces of the source document MS are simultaneously read by two image sensors, while the source documents MS are sequentially picked up from the document tray 22 and transported, and then the source documents MS are sequentially discharged. The analog output of each of the image sensors is converted into a digital signal, and image data representing the image of the source document MS is generated.

The image recording device 13 serves to print the image of the source document MS represented by the image data on a recording sheet P, and is configured to eject ink droplets of four colors (black, cyan, magenta, and yellow) onto the recording sheet P delivered from the paper feeding device 14, to thereby record the color image. To be more detailed, the image recording device 13 includes line heads 23, 24, 25, and 26, respectively corresponding to the black, cyan, magenta, and yellow colors. Thus, the ink jet recording apparatus 1 is a line-head type ink jet recording apparatus including one or a plurality of rows of the ink jet heads aligned in one direction. The line head according to this embodiment exemplifies the ink jet head in the disclosure.

The paper feeding device 14 includes a paper cassette 27. A feed roller 28 is provided on the paper cassette 27, to pick up the recording sheet P stored in the paper cassette 27 and deliver the recording sheet P to a transport route 31.

The paper feeding device 14 also includes a manual bypass tray 32, attached to a wall face of the main body of the apparatus. The recording sheet P set on the manual bypass tray 32 is picked up by a feed roller 33 and delivered to the transport route 31.

The transport device 15 includes a transport route 31 for transporting the recording sheet P delivered from the paper feeding device 14, a transport route 38 for transporting the recording sheet P delivered through the conveying device 16, transport rollers 35 provided at predetermined positions on the transport routes 31 and 38, a resist roller 36 that corrects a skew of the recording sheet P, and delivers the recording sheet P to the conveying device 16 in synchronization with the start of the image recording by the image recording device 13, and a discharge roller 42 that discharges the recording sheet P transported along the transport route 38 to an output tray 41.

The conveying device 16 includes a drive roller 43, a follow-up roller 44, a tension roller 45, a conveying belt 46, and an adsorption roller 47. The conveying belt 46 is an endless belt, running around the drive roller 43, the follow-up roller 44, and the tension roller 45. The drive roller 43 is driven to rotate counterclockwise by a non-illustrated motor, and when the drive roller 43 is driven the conveying belt 46 is made to run counterclockwise, and the follow-up roller 44 and the tension roller 45 are made to rotate counterclockwise so as to follow up the rotation of the drive roller 43.

The tension roller 45 serves to maintain the tension of the conveying belt 46 at an appropriate level. The adsorption roller 47 is located in contact with the conveying belt 46, and charges the conveying belt 46 to electrostatically adsorb the recording sheet P delivered from the paper feeding device 14 to the conveying belt 46.

The elevation mechanism 48 supports the conveying device 16 from below, and moves the conveying device 16 up and downward with respect to the line heads 23 to 26 of the image recording device 13. In other words, the elevation mechanism 48 moves the conveying device 16 relative to the line heads 23 to 26, to thereby locate the conveying device 16 and the line heads 23 to 26 closer to each other or away from each other. More specifically, the elevation mechanism 48 moves the conveying device 16 between a recording position that enables the image recording device 13 to execute printing (position shown in FIG. 1) and a maintenance position spaced downward from the recording position by a predetermined distance.

When the elevation mechanism 48 moves the conveying device 16 downward to the maintenance position, an open space is formed under the image recording device 13. In this state, a moving mechanism 56 (see FIG. 2) horizontally moves the cap 18 to a position under the image recording device 13, and then moves the cap 18 upward, so that the nozzles of the line heads 23 to 26 of the image recording device 13 are covered with the cap 18. Thus, the ink in the nozzles of the line heads 23 to 26 of the image recording device 13 is prevented from drying out.

A branch path 51 is connected to the transport route 38, and a branch nail 52 is provided at the junction point between the transport route 38 and the branch path 51. Further, a reverse transport route 54 is connected to the branch path 51, and a branch nail 55 is provided at the junction point between the branch path 51 and the reverse transport route 54. The branch nail 52 serves to conduct the recording sheet P to the discharge roller 42 through the transport route 38, or to the branch path 51. When the branch nail 52 conducts the recording sheet P to the branch path 51 from the transport route 38, the recording sheet P is transported along the branch path 51 to the transport roller 53, where a switch-back operation, including once stopping the rotation of the transport roller 53 and then rotating the same in the reverse direction, is performed. Then the trailing edge of the recording sheet P, caught by the transport roller 53, is conducted by the branch nail 55 to the reverse transport route 54, so that the recording sheet P is returned to the image recording device 13 through the reverse transport route 54, with the back face oriented upward. The group of components involved in the switch-back operation, namely the branch path 51, the branch nail 52, the transport roller 53, the reverse transport route 54, and the branch nail 55, constitute a switch-back mechanism 50.

When the image recording device 13 records the image of the source document MS only on the front face of the recording sheet P, the recording sheet P is conducted to the discharge roller 42 through the transport route 38, after the image recording device 13 has recorded the image on the front face of the recording sheet P, and discharged to the output tray 41.

When the image recording device 13 records the respective images of two source documents MS, or the respective images on the front and back faces of the source document MS, on the front and back faces of the recording sheet P, the recording sheet P is conducted to the branch path 51 from the transport route 38, after the image recording device 13 has recorded one of the images on the front face of the recording sheet P Then the recording sheet P is subjected to the switch-back operation, thus to be returned to the image recording device 13 with the back face oriented upward, through the reverse transport route 54, for the image recording device 13 to record the other image on the back face of the recording sheet P, and is conducted to the discharge roller 42 through the transport route 38, to be discharged to the output tray 41.

The CIS 17, exemplifying the error information acquisition device in the disclosure, is located upstream of the resist roller 36, in the transport direction of the recording sheet P The image of the recording sheet P read by the CIS 17 is utilized to detect an error with the recording sheet P, for example (i) the recording sheet P is bent or perforated, (ii) the size of the recording sheet P disaccords with the designated size, or (iii) the position of the recording sheet P is deviated. The control of the operations described above is executed by a controller 61 (see FIG. 2).

Figure 2:
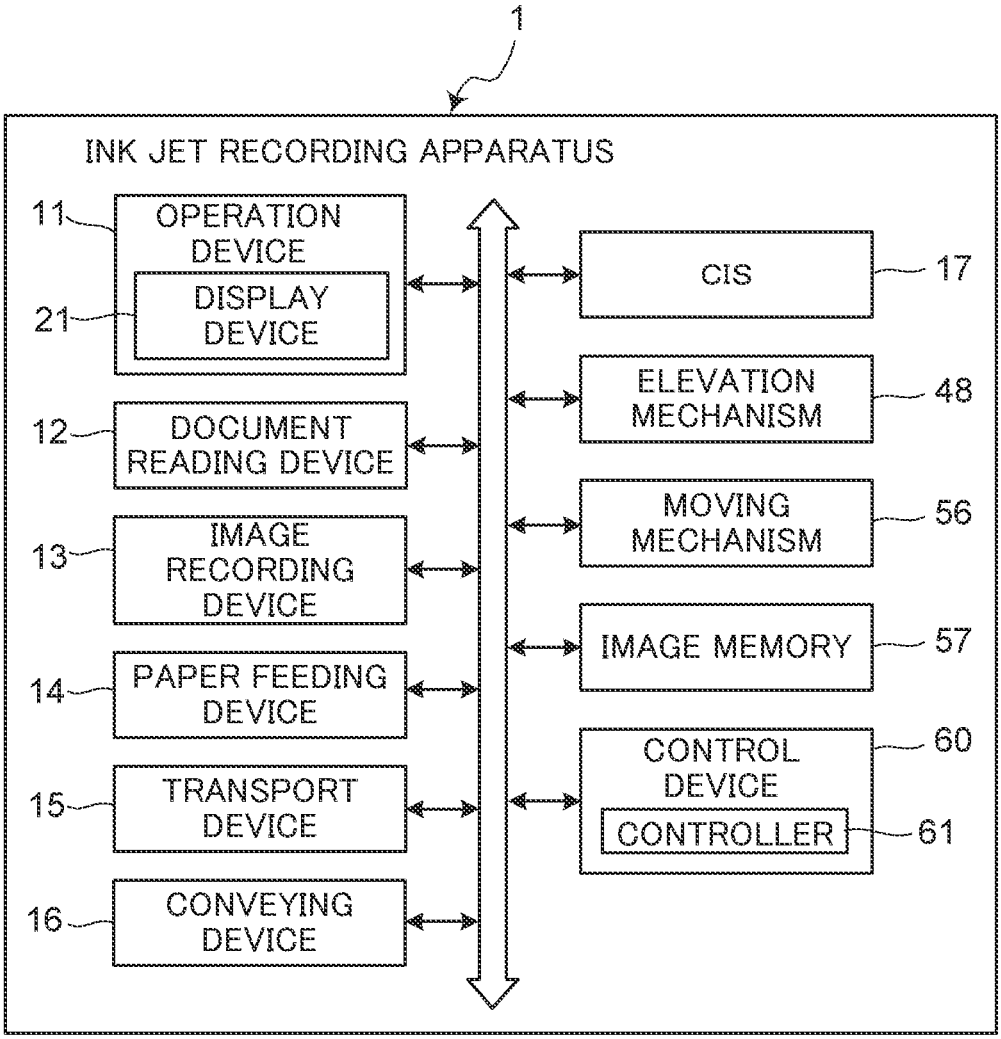
FIG. 2 is a functional block diagram showing an essential internal configuration of the ink jet recording apparatus according to the embodiment.

FIG. 2 is a functional block diagram showing an essential internal configuration of the ink jet recording apparatus according to this embodiment. The ink jet recording apparatus 1 includes the operation device 11, the document reading device 12, the image recording device 13, the paper feeding device 14, the transport device 15, the conveying device 16, the CIS 17, the elevation mechanism 48, the moving mechanism 56 that moves the cap 18 in a horizontal direction and up-down direction as above, an image memory 57, and a control device 60. The same components as those of the ink jet recording apparatus 1 shown in FIG. 1 are denoted by the same reference numerals.

The control device 60 includes a processor, a random-access memory (RAM), a read-only memory (ROM), and an exclusive hardware circuit. The processor is, for example, a central processing device (CPU), an application specific integrated circuit (ASIC), or a micro processing device (MPU). The control device 60 includes a controller 61.

The control device 60 acts as the controller 61, when the processor operates according to a control program stored in a built-in non-volatile memory. Here, the controller 61 may be constituted in the form of a hardware circuit, instead of being realized by the operation of the control device 60 according to the control program.

The controller 61 controls the overall operation of the ink jet recording apparatus 1. The controller 61 is connected to the operation device 11, the document reading device 12, the image recording device 13, the paper feeding device 14, the transport device 15, the conveying device 16, the CIS 17, the elevation mechanism 48, the moving mechanism 56, and the image memory 57, to control the operation of the mentioned components.

For example, the controller 61 controls the motor that drives the transport roller for transporting the source document MS, and the image sensor in the document reading device 12, to cause the document reading device 12 to read the image of the source document MS, and stores such image in the image memory 57. The controller 61 also controls the line heads 23 to 26 of the image recording device 13, to cause the image recording device 13 to record the image of the source document MS in the image memory 57, on the recording sheet P.

In addition, the controller 61 the motors that drive the feed roller, the transport roller, and the resist roller in the paper feeding device 14, the transport device 15, and the reverse transport route 54, the actuator that switches the direction of the branch nails 52 and 55, and the motor that drives the drive roller 43 in the conveying device 16, so as to transport the recording sheet P.

Further, the controller 61 controls the motor and the actuator in the elevation mechanism 48 and the moving mechanism 56, to move the conveying device 16 up and downward, and move the cap 18 in the horizontal direction and the up-down direction.

Now, in the ink jet recording apparatus 1 according to this embodiment, when a plurality of source documents MS are placed on the document tray 22 of the document reading device 12, the controller 61 causes the document reading device 12 to sequentially read the respective images of the source documents MS, sequentially stores the images of the source documents MS in the image memory 57, causes the paper feeding device 14 to sequentially deliver a plurality of recording sheets P to the image recording device 13 from the paper cassette 27, and causes the image recording device 13 to sequentially record the images of the source documents MS in the image memory 57 on the respective recording sheets P.

The controller 61 also analyzes the recording sheet image read by the CIS 17 using a known technique, to decide whether an error such as (i) to (iii) above has occurred.

For example, upon deciding through the analysis that no error has occurred with the recording sheet P, the controller 61 causes the image recording device 13 to record the image on the front face of the recording sheet P When the image is to be recorded only on the front face of the recording sheet P, the controller 61 conducts the recording sheet P to the discharge roller 42 through the transport route 38 and discharges the recording sheet P to the output tray 41. When images are to be respectively recorded on the front and back faces of the recording sheet P, the controller 61 causes the switch-back mechanism 50 to return the recording sheet P to the image recording device 13, through the branch path 51 and the reverse transport route 54 from the transport route 38. In this process, the controller 61 causes the switch-back mechanism 50 to pick up the recording sheet from the position in the transport route 31 downstream of the image recording device 13 in the transport direction of the recording sheet, and return the recording sheet to the position in the transport route 31 upstream of the image recording device 13 in the transport direction of the recording sheet, thereby turning the recording sheet upside down.

Upon deciding that an error has occurred with the recording sheet P, the controller 61 causes the image recording device 13 to suspend the recording of the image on the recording sheet P, and conducts the recording sheet P to the discharge roller 42 through the transport route 38, and then to the output tray 41. When the next recording sheet P has already been delivered at this point from the paper cassette 27, to a position in the transport route 31 upstream of the recording sheet P with the error in the transport direction of the recording sheet, the controller 61 causes the image recording device 13 to also suspend the image recording on the next recording sheet P, and to perform a protective ejection (That is, in-paper ejection) to the next recording sheet P, and then conducts the next recording sheet P to the discharge roller 42 through the transport route 38, and to the output tray 41.

The protective ejection (in-paper ejection) refers to an operation including causing the image recording device 13 to eject a predetermined minute amount of ink onto the recording sheet P, from the nozzles of the line heads 23 to 26. With such an operation, the nozzles of the line heads 23 to 26 can be, for example, prevented from drying out. The term "predetermined minute amount of ink" herein refers to an extremely or sufficiently small amount, compared with the normal ejection amount for recording an image on the recording sheet P More specifically, the minute amount corresponds to, for example, one or a few droplets from each nozzle.

Upon deciding that an error has occurred with the recording sheet P, the controller 61 also causes the display device 21 of the operation device 11 to display a message notifying that the error has occurred. In view of the message, the user can set a recording sheet P of the designated size on the manual bypass tray 32, and input an instruction to resume the image recording, through the operation device 11. In response to the instruction, the controller 61 causes the feed roller 33 to pick up the recording sheet P from the manual bypass tray 32, reads out the image, the recording of which has been suspended, from the image memory 57, and causes the image recording device 13 to record the image the recording of which has been suspended on the front face of the recording sheet P, and to deliver the recording sheet P to the transport route 38. When the recording of other images, subsequent to the image the recording of which has been suspended, is also suspended, the controller 61 reads out those subsequent images from the image memory 57, and transports additional recording sheets P from the paper cassette 27 of the manual bypass tray 32 along the transport route 31, to cause the image recording device 13 to record the subsequent images. When those images are to be recorded only on the front face of the recording sheet P, the controller 61 conducts the recording sheets P to the discharge roller 42 through the transport route 38, and discharges the same to the output tray 41. When the subsequent images are to be respectively recorded on the front and back faces of the recording sheet P, the controller 61 returns the recording sheets P to the image recording device 13, from the transport route 38 and through the branch path 51 and the reverse transport route 54, and causes the image recording device 13 to record the corresponding image on the back face.

The mentioned arrangement restricts the image recording from being performed on the recording sheet P with which the error has been detected, and also on the recording sheets P that may have already been delivered to the transport route at this time, thereby preventing wasteful consumption of the ink. Further, since the protective ejection is performed on those recording sheets P, the ink at the nozzles of the line heads 23 to 26 of the image recording device 13 can be prevented from drying out, and therefore degradation in quality of the image recorded on the recording sheet P delivered from the manual bypass tray 32 can be prevented.

Figure 3:
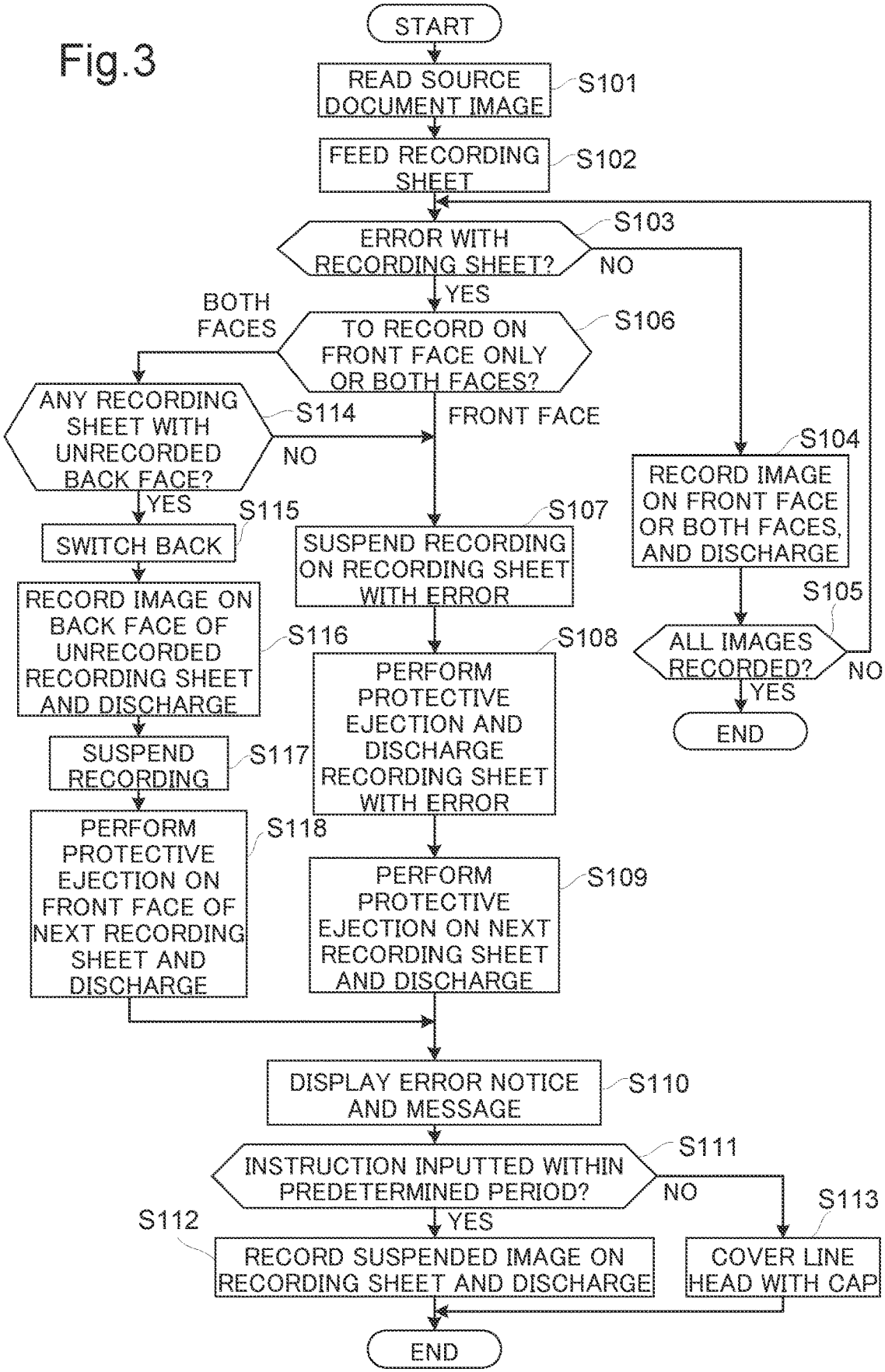
FIG. 3 is a flowchart showing a control process for recording an image depending on whether an error has occurred with a recording sheet, performing a protective ejection, and transporting the recording sheet.

Hereunder, the control process of the image recording to be performed depending on whether an error has occurred with the recording sheet P, the protective ejection, and the transport of the recording sheet P will be described in detail, with reference to the flowchart of FIG. 3.

First, the user sets a plurality of source documents MS on the document tray 22 of the document reading device 12, and inputs an instruction to perform the image recording on the front face or both faces of the recording sheet P, through the operation device 11. The controller 61 controls the document reading device 12 so as to sequentially read the images of the respective source documents MS, and stores the images of the source documents MS in the image memory 57 (S101).

The controller 61 then controls the paper feeding device 14 and the transport device 15 so as to deliver a plurality of recording sheets P from the manual bypass tray 32 or the paper cassette 27, to the image recording device 13 through the transport route 31 (S102). The controller 61 also analyzes the recording sheet image outputted from the CIS 17, to sequentially decide whether there is an error with the recording sheet P delivered from the manual bypass tray 32 or the paper cassette 27 (S103).

For example, upon deciding that no error has occurred with the recording sheet P (No at S103), the controller 61 causes the image recording device 13 to record the image on the recording sheet P, and to deliver the recording sheet P to the transport route 38 (S104). In the case where the image recording on the front face of the recording sheet P was instructed at S101, the controller 61 causes the image recording device 13 to record the image of the source document MS in the image memory 57 only on the front face of the recording sheet P, and conducts the recording sheet P to the discharge roller 42 through the transport route 38, then to the output tray 41. In the case where the image recording on the both faces of the recording sheet P was instructed at S101, the controller 61 causes the image recording device 13 to record the image of the source document MS in the image memory 57 on the front face of the recording sheet P, and returns the recording sheet P to the image recording device 13 from the transport route 38, through the branch path 51 and the reverse transport route 54, acting as the switch-back mechanism 50. Then the controller 61 causes the image recording device 13 to record another image of the source document MS in the image memory 57 on the back face of the recording sheet P, and conducts the recording sheet P to the discharge roller 42 through the transport route 38, then to the output tray 41.

Thereafter, the controller 61 decides whether all the images of the source documents MS in the image memory 57 have been recorded (S105). When it is decided that all the images of the source documents MS have not yet been recorded (No at S105), the operation returns to S103. When it is decided that all the images of the source documents MS have been recorded (Yes at S105), the control process shown in FIG. 3 is finished.

In contrast, upon deciding that an error has occurred with the recording sheet P (Yes at S103), the controller 61 decides whether the instruction given at S101 was to record the image only on the front face of the recording sheet P, or on both faces thereof (S106).

Upon deciding, for example, that the image recording only on the front face of the recording sheet P was instructed at S101 ("Front Face" at S106), the controller 61 causes the image recording device 13 to immediately suspend the image recording on the recording sheet P, with which the error was detected at S103 (S107). More specifically, for example, the controller 61 masks (e.g., convert into blank data) the image of the source document MS in the image memory 57, thereby restricting the image of the source document MS from being outputted to the image recording device 13. Further, the controller 61 causes the image recording device 13 to perform the protective ejection onto the recording sheet P, and conducts the recording sheet P to the discharge roller 42 through the transport route 38, then to the output tray 41 (S108). In the case where the next recording sheet P has already been delivered, at the time that the error has been detected at S103, to the transport route 31 at a position upstream of the recording sheet P with the error, in the transport direction of the recording sheet, the controller 61 causes the image recording device 13 to suspend the image recording on the next recording sheet P (S107), and to perform the protective ejection instead, onto the next recording sheet P (S108). Then the controller 61 conducts the next recording sheet P, which has been subjected to the protective ejection, to the discharge roller 42 through the transport route 38, and discharges the same to the output tray 41 (S109).

Figure 4:
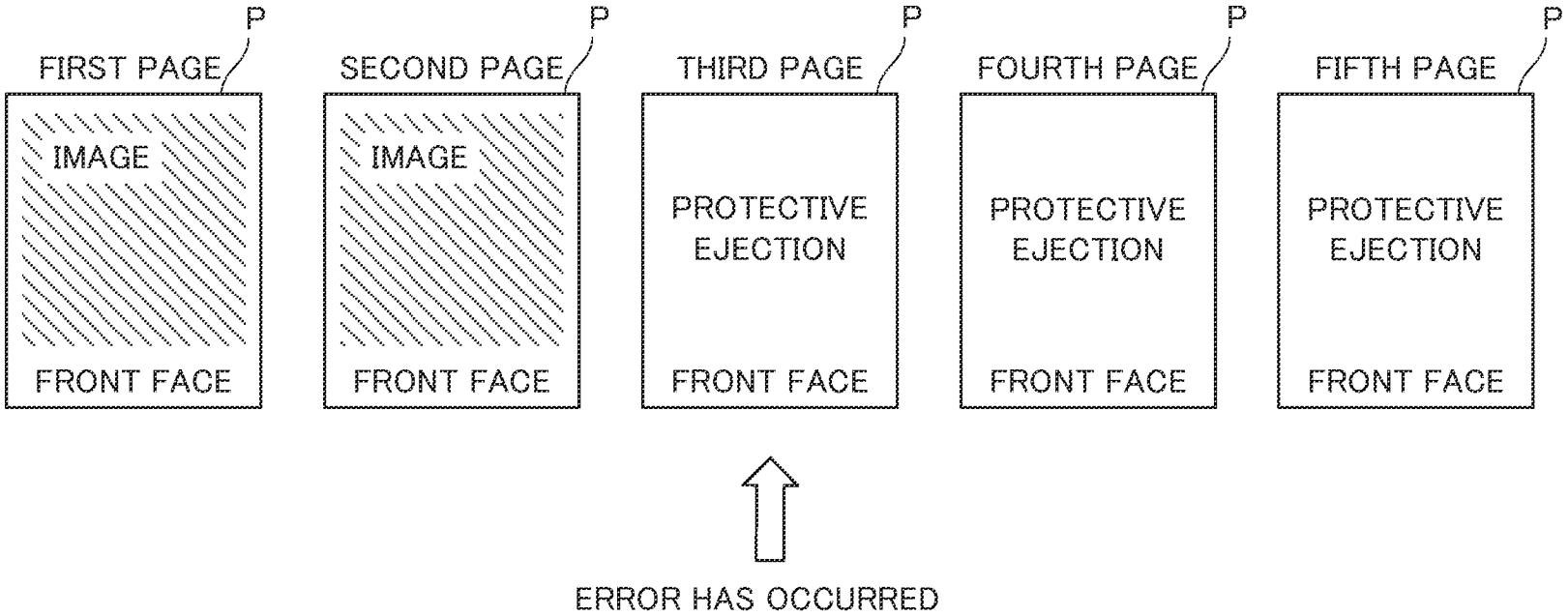
FIG. 4 is a schematic drawing showing recording sheets on which an image has been recorded and recording sheets on which the protective ejection is performed, when an error has occurred with one of a plurality of recording sheets, on each of which an image is to be recorded only on the front face.

When the error has occurred, for example, with a third recording sheet P of five recording sheets P as shown in FIG. 4, images are respectively recorded on a first and second recording sheets P, and the first and second recording sheets P are discharged to the output tray 41. The third recording sheet P is not subjected to the image recording, but to the protective ejection, and discharged to the output tray 41. In the case where a fourth and fifth recording sheets P had already been delivered to the transport route 31, by the time that the paper feeding from the paper cassette 27 was suspended, the fourth and fifth recording sheets P are not subjected to the image recording but to the protective ejection, and discharged to the output tray 41.

Further, upon suspending the image recording on the recording sheet P with the error, the controller 61 causes the display device 21 of the operation device 11 to display a message notifying the occurrence of the error with the recording sheet P, and also a message urging the user to set a recording sheet P of the designated size on the manual bypass tray 32, and resume the image recording (S110). The controller 61 then counts the elapsed time after the time that the messages have been displayed, and decides whether the user has inputted the instruction to resume the image recording through the operation device 11, before the elapsed time reaches a predetermined period (S111).

In view of the message, the user can set the recording sheet P of the designated size on the manual bypass tray 32, and input the instruction to resume the image recording, through the operation device 11. In the case where the controller 61 decides that the instruction to resume the image recording has been inputted through the operation device 11, before the elapsed time reaches the predetermined period, (Yes at S111), the controller 61 causes additional recording sheets P to be delivered to the transport route 31 from the manual bypass tray 32 or the paper cassette 27, reads out the image, the recording of which was suspended, from the image memory 57, causes the image recording device 13 to record the image the recording of which was suspended, on the front face of the recording sheet P, and conducts the recording sheet P to the transport route 38. In the case where the recording of a plurality of images is suspended, for example the images for the third, fourth, and fifth recording sheets P in FIG. 4, the controller 61 causes the image recording device 13 to record those images on the front face of the respective recording sheets P, delivered from the paper cassette 27 or the manual bypass tray 32, and conducts the recording sheets P to the transport route 38 (S112). Thereafter, the control process shown in FIG. 3 is finished.

In this case, the image recording once suspended is resumed immediately after the protective ejection of S109, in other words before the ink at the nozzles of the line heads 23 to 26 of the image recording device 13 dries out, and therefore degradation in image quality can be prevented.

In the case where the elapsed time reaches the predetermined period before the instruction to resume the image recording is inputted through the operation device 11 (No at S111), the controller 61 controls the elevation mechanism 48 to move the conveying device 16 away from the line heads 23 to 26, and controls the moving mechanism 56 to horizontally move the cap 18 to the position right under the image recording device 13. Then the controller 61 moves the cap 18 upward so as to cover the nozzles of the line heads 23 to 26 of the image recording device 13 (S113), and finishes the control process shown in FIG. 3. With such an operation, the ink at the nozzles of the line heads 23 to 26 of the image recording device 13 can be prevented from drying out.

Now, upon deciding that the image recording on both faces of the recording sheet P was instructed at S101 ("Both Faces" at S106), the controller 61 decides whether there is any recording sheet P on which the image of the source document MS has already been recorded on the front face, but another image of the source document MS has not been recorded on the back face, among the recording sheets P located downstream of the recording sheet P with which the error was detected at S103, in the transport direction of the recording sheet (S114).

Upon deciding that there is no recording sheet P on which the image has been recorded on the front face but another image has not been recorded on the back face, in other words that all the recording sheets P have the image recorded on neither faces (No at S114), the controller 61 performs the operation according to S107 to S113 as described above. To be more detailed, the controller 61 causes the image recording device 13 to suspend the image recording on the recording sheet P with which the error was detected at S103, and the recording sheet P having the image on neither faces (S107), and causes the image recording device 13 to perform the protective ejection onto the front face of these recording sheets P (S108). At the same time, the controller 61 suspends the paper feeding from the paper cassette 27 and the manual bypass tray 32. In the case where, at this point, one or more additional recording sheets P have already been delivered to the transport route 31, from the paper cassette 27 or the manual bypass tray 32, the controller 61 causes the image recording device 13 to perform the protective ejection onto the front face of all those recording sheets P (S109). In other words, the controller 61 restricts the switch-back mechanism 50 to perform the switch-back action for those additional recording sheets P, despite the instruction to record the image on both faces having been inputted, and causes the image recording device 13 to perform the protective ejection only on the front face of those recording sheets P. Further, the controller 61 causes the display device 21 to display the aforementioned message (S110). Upon deciding that the instruction to resume the image recording has been inputted through the operation device 11, before the elapsed time reaches the predetermined period (Yes at S111), the controller 61 causes the image recording device 13 to record the corresponding images on the front face of the respective recording sheets P delivered from the manual bypass tray 32, and conducts the recording sheets P to the transport route 38 (S112). In contrast, upon deciding that the elapsed time has reached the predetermined period before the instruction to resume the image recording is inputted (No at S111), the controller 61 controls the moving mechanism 56 to horizontally move the cap 18 to the position right under the image recording device 13 and then upward, thereby covering the nozzles of the line heads 23 to 26 of the image recording device 13 with the cap 18 (S113).

In the case where the controller 61 decides that there are one or more recording sheets P on which the image has been recorded on the front face but another image has not been recorded on the back face (Yes at S114), the controller 61 causes the switch-back mechanism 50 to perform the switch-back action, so as to return such recording sheets P to the image recording device 13 (S115), and causes the image recording device 13 to record the corresponding images on the back face of the respective recording sheets P Then the controller 61 conducts the recording sheets P to the discharge roller 42 through the transport route 38, and then to the output tray 41 (S116).

Thereafter, the controller 61 causes the image recording device 13 to suspend the image recording (S117). Regarding the recording sheets P on the front face which the protective ejection was performed, the controller 61 may skip the switch-back action by the switch-back mechanism 50, and conduct those recording sheets P, with only the front face subjected to the protective ejection, to the discharge roller 42 through the transport route 38, and then to the output tray 41, instead of performing the operation according to S115 to S117 as described above.

Further, in the case where one or more additional recording sheets P have already been delivered to the transport route 31, from the paper cassette 27 or the manual bypass tray 32, the controller 61 causes the image recording device 13 to suspend the image recording (S117) and to perform the protective ejection only on the front face of all those recording sheets P, and conduct the recording sheets P to the discharge roller 42 through the transport route 38, and then to the output tray 41 (S118).

Figure 5:
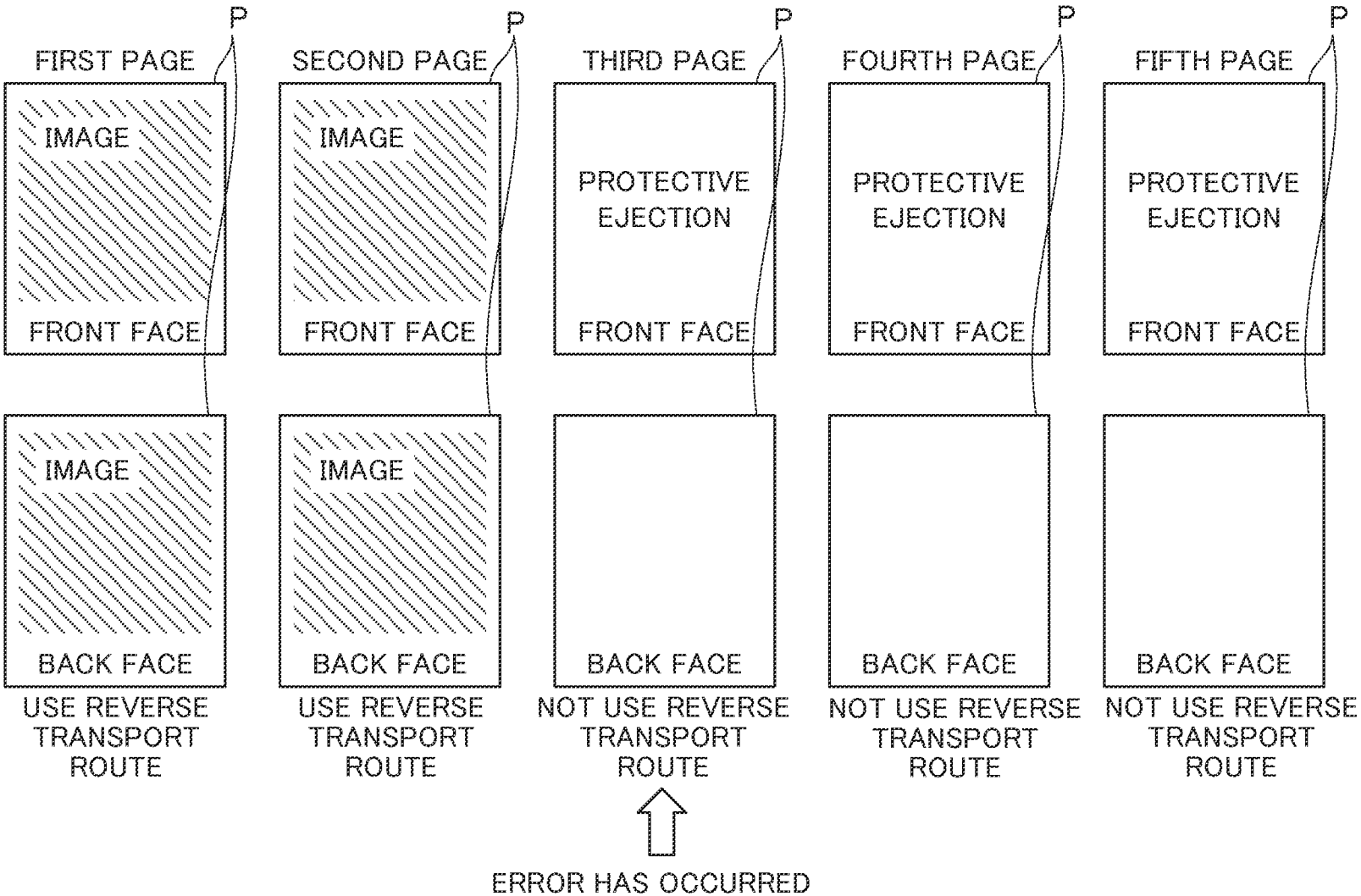
FIG. 5 is a schematic drawing showing recording sheets on which an image has been recorded and recording sheets on which the protective ejection is performed, when an error has occurred with one of a plurality of recording sheets, on each of which images are to be respectively recorded on the front and back faces.

When the error has occurred, for example, with a third recording sheet P of five recording sheets P as shown in FIG. 5, images are respectively recorded on the front and back faces of the first recording sheet P, and the first recording sheet P is discharged to the output tray 41. When an image has been recorded on the front face of the second recording sheet P but not yet on the back face thereof, the second recording sheet P is discharged to the output tray 41, after another image is recorded on the back face of the second recording sheet P On the front face of the third recording sheet P the protective ejection is performed, but neither the image recording nor the protective ejection is performed on the back face of the third recording sheet P Further, in the case where the fourth and fifth recording sheets P have already been delivered to the transport route 31 by the time that the paper feeding from the paper cassette 27 is suspended because an error has been detected, the protective ejection is performed, instead of the image recording, on the front face of the fourth and fifth recording sheets P, and the fourth and fifth recording sheets P are discharged to the output tray 41, without being subjected to the switch-back operation.

Thereafter, the controller 61 performs the operation according to S110 to S113 as described above.

With the arrangement according to this embodiment, as described thus far, the image recording is restricted to a maximum possible extent, for the recording sheet P with which an error has been detected, and one or more subsequent recording sheets P being transported, and therefore wasteful consumption of the ink can be prevented. In addition, since the protective ejection is performed on those recording sheets P, the ink at the nozzles of the line heads 23 to 26 of the image recording device 13 can be prevented from drying out, and therefore degradation in quality of the image recorded on the recording sheets P, delivered from the manual bypass tray 32, can be prevented.

In the case of the existing ink jet recording apparatuses referred to above as background art, when an error occurs with the recording sheet, the corresponding images are respectively recorded on a plurality of recording sheets being transported at that time, and such recording sheets are discharged. Accordingly, suspending the image recording on those recording sheets may lead to prevention of wasteful consumption of the ink. However, when the image recording is suspended, the ink ejection from the ink jet head is also suspended, which leads to a drawback in that the ink at the nozzles of the ink jet head may dry out, and the nozzles may be clogged.

Alternatively, it is also possible to suspend the image recording on the recording sheets being transported, and cover the nozzles of the ink jet head with a cap, thereby preventing the ink at the nozzles from drying out. In this case, however, it takes a long time to cover the nozzles with the cap, and therefore a long time is spent before the image recording can be resumed.

Further, even with the technique of another printing system described in the above background art, in other words transmitting blank data for the recording sheet detained because of an error, as print data for the other face, thereby preventing additional consumption of the toner, the clogging of the nozzles of the ink jet head is unable to be prevented.

Unlike the above, the arrangement according to this embodiment prevents wasteful consumption of the ink, and also drying out of the ink at the nozzles of the ink jet head, when the image recording is suspended because of an error with the recording sheet, and allows the image recording to be promptly resumed.

In the foregoing embodiment, the image recording may be resumed on the recording sheets P delivered from the manual bypass tray 32, and in the case where an automatic cassette changer, configured to automatically switch the recording sheet source among a plurality of paper cassettes 27, is provided in the ink jet recording apparatus, the paper cassette 27 from which the recording sheets P are to be delivered may be switched, and the image recording may be resumed on the recording sheets P delivered from the paper cassette 27 that has been selected.

In the case where, while the image recording on both faces of the recording sheet P is in process according to an instruction inputted at S101, another recording sheet P is present, at the time that an error has been detected, on the transport device 15 or the transport route 31 at a position upstream (or downstream) of the recording sheet P with which the error has been detected, in the transport direction of the recording sheet, and an image has already been recorded on the front face of the other recording sheet P on the upstream side (or downstream side), the controller 61 may cause the switch-back mechanism 50 to turn such other recording sheet P upside down, and cause the image recording device 13 to record another image on the back face of the other recording sheet P. In this case, the other recording sheet P on both faces of which the images have been recorded can be utilized as it is, as the recording sheet on which the images have been normally recorded.

Further, the configurations and processings described in the foregoing embodiments with reference to FIG. 1 to FIG. 5 are merely exemplary, and in no way intended to limit the disclosure to those configurations and processings.

While the present disclosure has been described in detail with reference to the embodiments thereof, it would be apparent to those skilled in the art the various changes and modifications may be made therein within the scope defined by the appended claims.

What is claimed is:

1. An ink jet recording apparatus comprising:

a paper feeding device that includes a paper cassette for storing a recording sheet, and feeds the recording sheet from the paper cassette;

a transport device that sequentially transports a plurality of recording sheets delivered from the paper feeding device;

an image recording device that includes an ink jet head that ejects ink, and records an image on the recording sheet by ejecting the ink from the ink jet head onto the recording sheet transported by the transport device;

an error information acquisition device located upstream of the image recording device in a transport direction of the recording sheet, and configured to acquire information to be used to detect an error with the recording sheet transported by the transport device; and a control device including a processor, and configured to act, when the processor executes a control program, as a controller that causes the image recording device, upon detecting an error with the recording sheet according to the information acquired by the error information acquisition device, to:

suspend the image recording on the recording sheet with which the error has been detected, and on another recording sheet being transported upstream in the transport direction, of the recording sheet with which the error has been detected; and perform a predetermined protective ejection including protecting the ink jet head of the image recording device, by ejecting a limited minute amount of ink from the ink jet head, at least onto a recording sheet transported subsequent to the recording sheet the image recording on which has been suspended.

2. The ink jet recording apparatus according to claim 1, wherein the transport device includes:

a transport route along which the recording sheet is transported; and a switch-back mechanism that turns the recording sheet upside down, by drawing out the recording sheet from a position on the transport route downstream of the image recording device in the transport direction, and returning the recording sheet to a position on the transport route upstream of the image recording device in the transport direction, and in a case where, in a duplex printing process, an image has already been recorded on a front face of another recording sheet being transported by the transport device at a time that an error of the recording sheet has been detected, and located on the transport route at a position downstream in the transport direction, of the recording sheet with which the error has been detected, the controller causes the switch-back mechanism to turn the other recording sheet upside down, and causes the image recording device to record an image on a back face of the other recording sheet.

3. The ink jet recording apparatus according to claim 2, wherein, in a duplex printing process, in a case where an image has already been recorded on a front face of another recording sheet being transported by the transport device at a time that an error of the recording sheet has been detected, and located on the transport route at a position downstream in the transport direction, of the recording sheet with which the error has been detected, the controller causes the switch-back mechanism to turn the other recording sheet upside down, and causes the image recording device to record an image on a back face of the other recording sheet, and the controller causes the image recording device to perform the protective ejection, instead of the image recording, on a front face of a remaining recording sheet transported subsequent to the other recording sheet on the back face of which the image has been recorded, discharges the remaining recording sheet without activating the switch-back mechanism, and restricts the image recording device from recording an image and performing the protective ejection, on the back face of the remaining recording sheet.

4. The ink jet recording apparatus according to claim 1, further comprising:

a display device; and a cap constituting a part of the image recording device and configured to cover the ink jet head, wherein, upon suspending the image recording, the controller causes the display device to display a message notifying occurrence of an error, counts elapsed time after the message is displayed, and causes the image recording device to cover the ink jet head with the cap, when the image recording device is restricted from recording the image despite the elapsed time having reached a predetermined period.

5. The ink jet recording apparatus according to claim 1, wherein the error information acquisition device includes a contact image sensor, and detects an error of the recording sheet when (i) the recording sheet is bent or perforated, (ii) a size of the recording sheet disaccords from a designated size, or (iii) a position of the recording sheet is deviated.

* * * * *